United States Patent [19]

Olson

[11] 4,437,658

[45] Mar. 20, 1984

[54] BOTTOM SHEET FEED SYSTEM

[75] Inventor: Raymond E. Olson, Pompano Beach, Fla.

[73] Assignee: Profold, Inc., Pompano Beach, Fla.

[21] Appl. No.: 288,486

[22] Filed: Jul. 30, 1981

[51] Int. Cl.[3] ..... B65H 3/52

[52] U.S. Cl. ..... 271/125; 271/119; 271/146; 271/165

[58] Field of Search ..... 271/119, 120, 125, 146, 271/165, 166, 37

[56] References Cited

U.S. PATENT DOCUMENTS

| | | | |
|---|---|---|---|
| 2,635,874 | 4/1953 | LaBore | 271/125 X |
| 2,764,409 | 9/1956 | LaBombard | 271/146 X |
| 3,933,350 | 1/1976 | Mignano | 271/125 X |
| 4,330,116 | 5/1982 | Newsome | 271/216 X |

OTHER PUBLICATIONS

Rosback Catalog p. (Date unknown).

*Primary Examiner*—Richard A. Schacher

*Attorney, Agent, or Firm*—Hill, Van Santen, Steadman & Simpson

[57] ABSTRACT

A bottom sheet feed system employs a slated feed surface having a pair of apertures therein for receiving a respective agitator wheel. The agitator wheel is constructed of a plurality of freely rotating rollers spaced in a circle around a central axis of the agitator wheel. Downstream of the agitator wheels a nip is provided formed of a stationary retard surface and a feed wheel. As the agitator wheels rotate, they jostle bottommost sheets of the stack of sheets and cause these sheets to fan along the stationary retard surface which is preferably curved above the feed surface. With the system of the invention reliable operation is achieved in combination with high feed rates. Top loading of the stack of sheets during operation is facilitated since major upper portions of the stack of sheets abut against a perpendicular surface while only the bottommost sheets are fanned along the stationary retard surface curved portion.

7 Claims, 7 Drawing Figures

FIG. 1
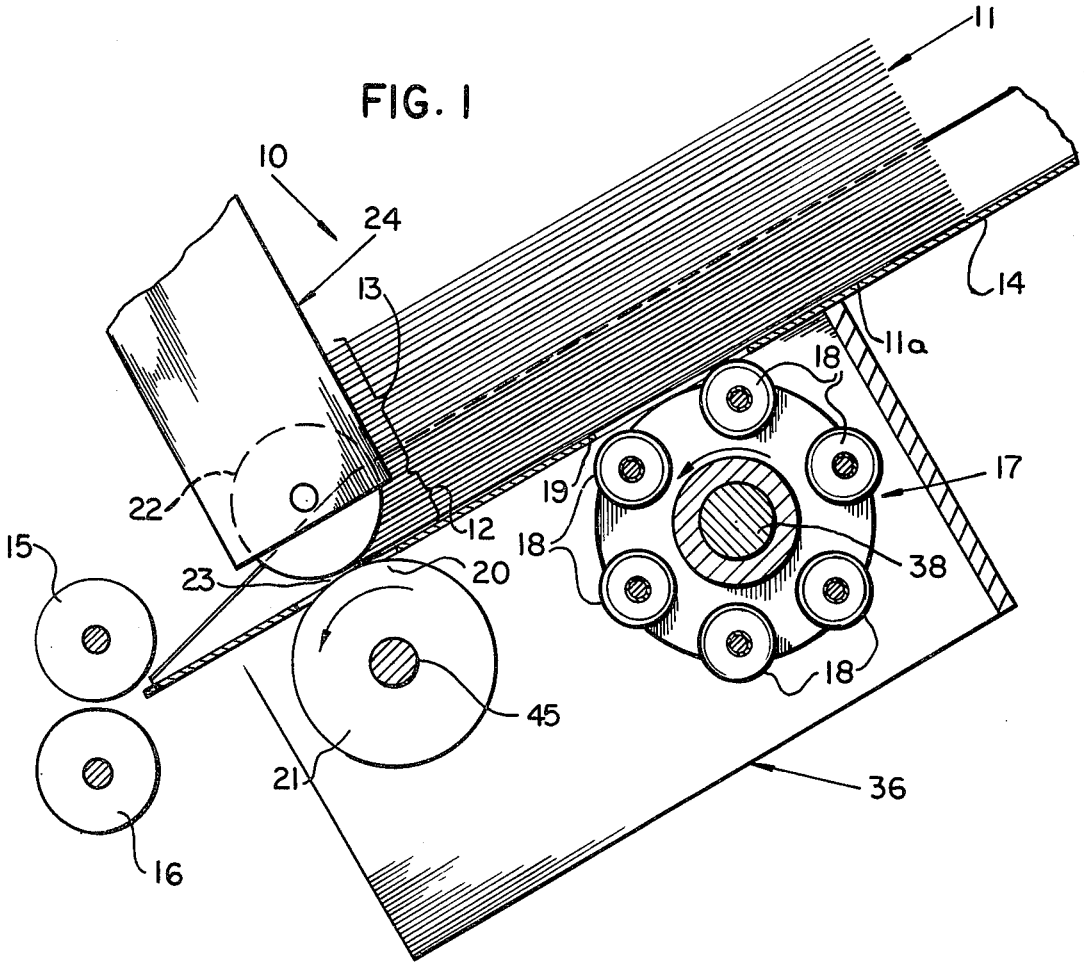
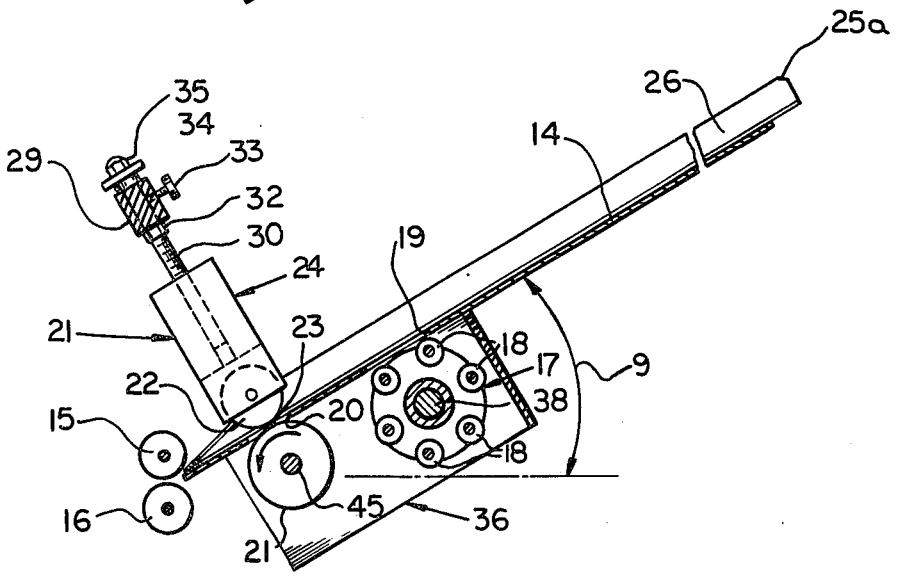
FIG. 2

BOTTOM SHEET FEED SYSTEM

BACKGROUND OF THE INVENTION

In sheet feed systems requiring rapid feed rates such as in paper folding machines where feed rates of at least 10,000 sheets per hour and as much as 20,000 sheets per hour are not uncommon, it is necessary to provide a system which can accommodate such rapid operation.

It has been known to feed sheets from the top of a stack of sheets such as by use of rotating rubber wheels in contact with the top sheets. However, such systems cannot accommodate rapid feed rates nor do they permit top loading during operation.

Systems are also known which are designed to feed sheets from a bottom of a stack of sheets, thus permitting loading during operation. However, such prior art systems have been relatively slow and have proved to be unreliable.

SUMMARY OF THE INVENTION

It is an object of the invention to provide a sheet feed system which can accommodate a feed rate of at least 10,000 sheets per hour and up to 20,000 sheets per hour.

It is a further object of the invention to provide a sheet feed system which is highly reliable and simple to adjust.

It is another object of the invention to provide a sheet feed system which feeds form a bottom of the stack and furthermore does not require a manual "fanning" of the stack.

According to the invention, a slanted feed surface is provided having an aperture therein. Beneath the aperture an agitator wheel is provided formed of a plurality of freely rotatable rollers arranged around a periphery of the agitator wheel. The wheel is positioned such that as it is driven, the individual freely rotatable rollers, preferably constructed of a fibrous material, jostle the stack of sheets when they strike the bottommost sheet. At a leading edge of the stack of sheets, at an edge of the feed surface a nip is provided formed of a driven feed wheel and a stationary retard wheel. As the agitator wheel rotates, the sheets at the bottom of the stack are jostled so that they automatically fan along a peripheral surface of the stationary retard wheel. Sheets in the upper portion of the stack abut against a perpendicular abutment surface. Due to the agitation, the bottom sheet is thrust into the nip formed between the two wheels. Consequently, as the feed wheel rotates, it pulls the bottommost sheet through. Preferably the feed wheel peripheral surface at the nip has a greater coefficient of friction than the corresponding coefficient of the stationary retard wheel at the peripheral adjacent the nip.

Means are provided for adjusting a spacing between the stationary retard wheel and the feed wheel so as to optimize passage of single bottommost sheets through the nip.

BRIEF DESCRIPTION OF THE DRAWINGS

FIG. 1 is a side view of important structural elements of the system of the invention;

FIG. 2 is a side view of the feed table with associated basic components of the inventive system;

DESCRIPTION OF THE PREFERRED EMBODIMENTS

Figure 3:
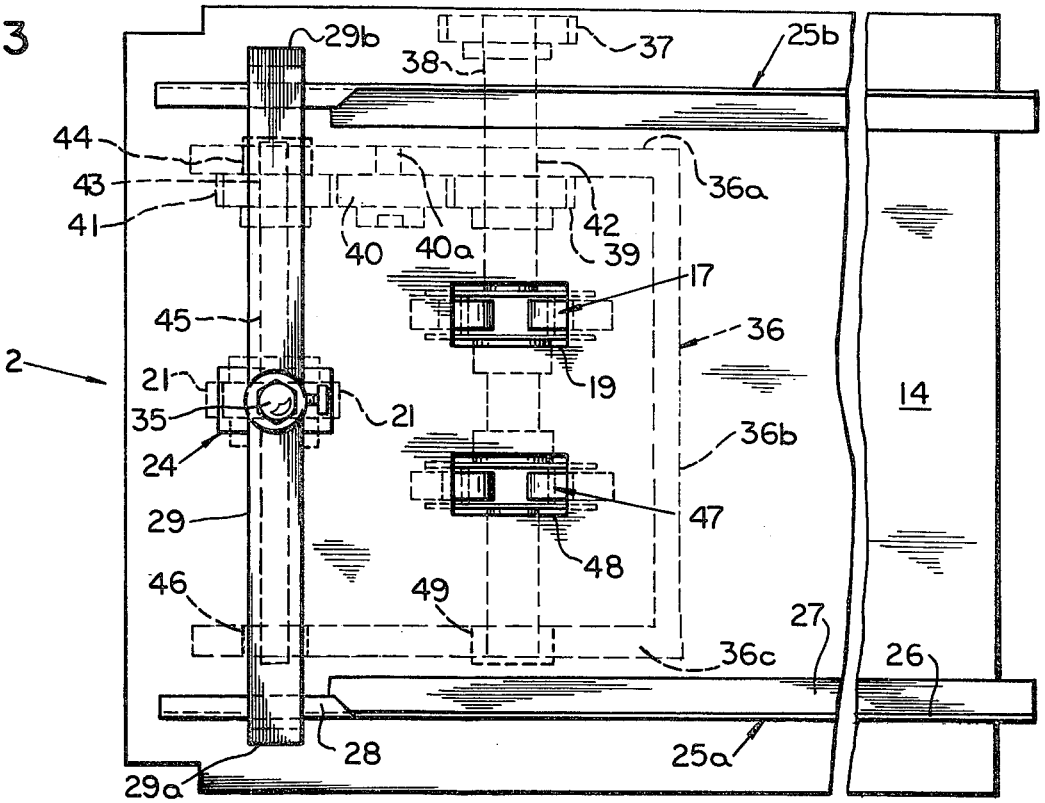
FIG. 3 is a top view of the entire bottom sheet feed system of the invention.

Basic elements of the bottom sheet feed system of the invention are generally shown at 10 in FIG. 1. A stack of sheets 11 with a bottom sheet 11*a* rests on a feed table or surface 14. Such a feed table is typically employed in a sheet folding machine requiring high volume sheet feed such as 10,000 sheets per hour or up to 20,000 sheets per hour.

A portion of a paper folding machine comprising an idler roller 15 and main roller 16 are shown by way of example in FIG. 1.

The feed surface 14 has apertures 19 and 48 (also see FIG. 3) below which are respectively positioned multi-roller agitator wheels 17 and 47. As shown in FIG. 1, agitator wheel 17 is comprised of a plurality of individual fiber rollers 18 spaced in a circle around a central axis of the agitator wheel 17. Each of these fiber rollers is freely rotatable when it contacts the bottom sheet 11*a* of the stack of sheets 11 when the agitator wheel 17 is driven by a shaft 38. A camming action occurs since the stack of sheets is repeatedly jostled each time one of the rollers 18 passes beneath the bottommost sheet 11*a*.

At a leading edge of the stack of sheets 11, in the feed direction an abutment surface in the form of a mounting block 24 is provided so that the leading edges of a majority of the sheets in the stack shown at 13 abut in perpendicular fashion on the surface.

At a lower end of the mounting block 24 a stationary retard wheel 22 is provided. As shown at 12, only sheets toward the bottom of the stack 11 (only the lower approximately $\frac{3}{8}$ inch of the stack as a maximum) are fanned along the curved peripheral surface of the retard wheel 22 with the lowermost sheet 11*a* being placed at the nip 23 formed between the retard wheel 22 and a driven rotatable feed wheel 21. Preferably wheel 21 is clutched in a given direction such that if the rotational speed of the folder drive roller 16 is greater than that of the agitator wheel 17 or feed wheel 21, the clutch may slip.

The nip 23 is preferably formed at an aperture 20 of the feed surface 14. This aperture is spaced in a feed direction from the aperture 19 and is laterally positioned between the two agitator wheels 17 and 47 as shown in FIG. 3.

Details for the one-way clutch on the feed wheel 21 have not been shown. However, as well known to those skilled in the art, a one-way clutch may be employed by provision of a wedge locking bearing which locks for opposite direction rotation, yet frees the wheel for free rotation in the forward direction.

The freely rotating rollers 18 on the agitator wheel 17 are preferably comprised of a fibrous material or of wood or plastic.

A linen based phenolic such as Spaldite Grade C, a trademark of the Spalding Fiber Co. is preferred. Other materials include Delrin, a trademark of the DuPont de Mours Co., Celcon, a trademark of Celanese Plastics Co., or a wood material such as Arguto, a trademark of the Arguto Co.

It has been found that the rollers should not be constructed of a material which has too great a coefficient of friction such as a soft rubber since the desired jostling action of the sheet stack without wrinkling or bending the bottommost sheet could not be obtained.

Figure 4:
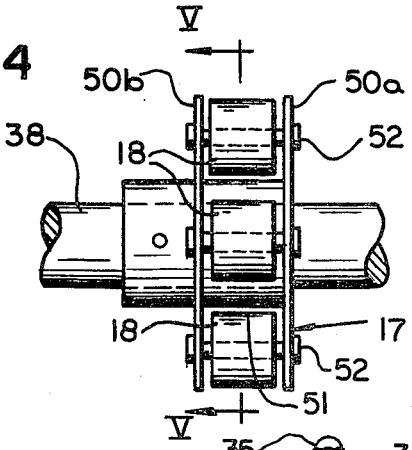
FIG. 4 is a frontal view of a multi-roller agitator wheel employed in the system of the invention.

As shown in FIG. 4 hereafter, the peripheral surface of the rollers is slightly convex as shown at 51.

The feed wheel 21 at the nip 23 preferably is comprised of a soft rubber for high friction coefficient whereas the stationary retard wheel 22 is preferably constructed of a material with a smaller coefficient of friction such as a hard rubber. This permits slippage of the retard wheel 22 along the top surface of the bottommost sheet 11*a* whereas the bottom surface of the sheet 11*a* is grabbed by the peripheral surface of the feed wheel 21.

With the invention, as the agitator wheel 17 rotates, the pile is jogged up and down so as to loosen the bottom sheet by vibration and at the same time to feather or fan the bottommost sheets along the peripheral bottom surface of the retard wheel 22.

Referring now to FIG. 2, the feed table 14 has an angle of tilt 9 which in practice can vary from 10° to 50° and preferably lies within the range 15° to 45°. With the system of the invention, the tilt angle is not critical as was the case in prior art systems.

On the top of the feed surface 14 L-shaped guide rails 25*a,b* are provided, each of which has a vertical leg 26 and a horizontal leg 27. These are freely positionable to accommodate varying widths for the stack of sheets employed. Near the nip 23 as shown most clearly in FIG. 3 an upper horizontal guide surface which slants downwardly is provided at 28 so as to guide edges of the sheet towards the nip 23.

To retain the retard wheel 22 and its connected mounting block 24 in position, a mounting bar 29 is provided attached at side support posts 29*a,b*.

The retard wheel mounting block 24 has a threaded aperture 31 therein for receiving an adjusting screw 30.

Adjusting screw 30 is retained within an aperture 34 of the support bar 29 by a collar 32. At the opposite end of the threaded screw 30 an adjustment knob 35 is provided. A locking screw 33 projects toward the threaded screw 30 in the locking bar 29 in order to lock the adjustment screw in position.

Beneath the support surface 14 a support housing 36 is provided as shown in FIG. 3 and partially shown in FIG. 2. Support housing 36 includes side walls 36*a,c* and front wall 36*b*.

The system is operated by a drive source not shown which preferably engages with the drive gear 37 on first drive shaft 38. Drive shaft 38 passes through aperture 42 of the sidewall 36*a* and has arranged thereon the two agitator wheels 17 and 47. The opposite end of the drive shaft is mounted in a bearing 49 in the side wall 36*c*. The two agitator wheels are thus positioned at the respective apertures 19 and 48.

On the first drive shaft 38 a first take-off gear 39 is provided which meshes with an idler gear 40 mounted in the sidewall 36*a* at 40*a*. At the other side of the idler gear 40 a second drive shaft 45 is provided which positions the drive wheel 21 at the aperture 20. One end of the drive shaft 45 is retained in a bearing 46 in the side wall 36*c* while the other end is retained in bearing 44 at the side wall 36*a*. The second gear 41 on the shaft 45 meshes with the idler gear 40.

Figure 5:
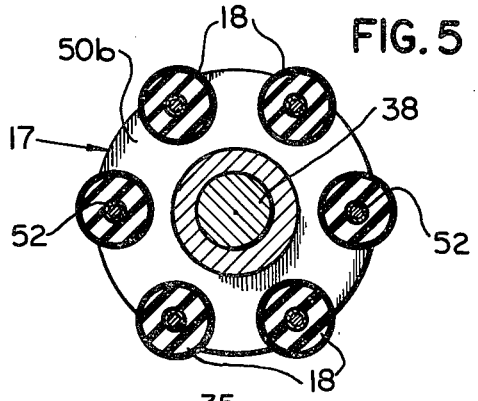
FIG. 5 is a cross-sectional view taken along line V—V.

As shown in FIGS. 4 and 5, the agitator wheel 17 comprises spaced apart support discs 50*a,b* as side frames. Between the side frames respective pin axles 52 comprising screws and bolts or pins with flared ends are positioned between the side frames for mounting of the freely rotatable rollers 18.

Figure 6:
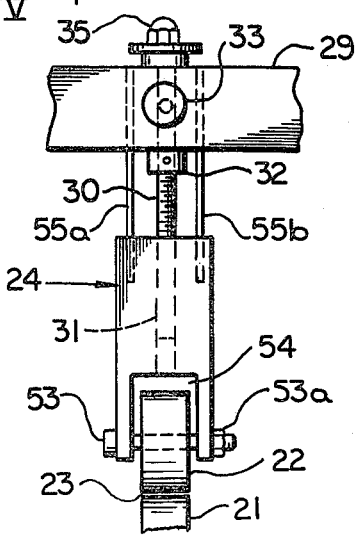
FIGS. 6 and 7 are respective side and frontal views of a feed nip employed in the inventive system.
Figure 7:
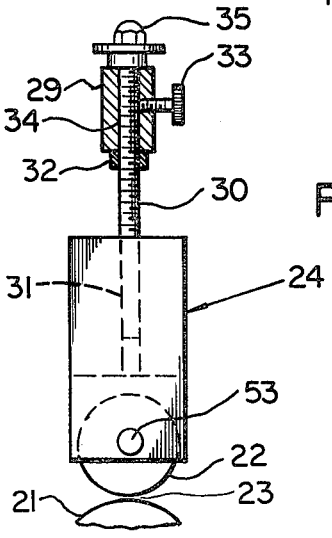

In FIGS. 6 and 7 the adjustment system for the retard wheel 22 is illustrated in greater detail. Here, a pocket 54 cut in the end of the mounting block 24 receives the retard wheel 22 mounted on an axle 53 firmly attached to the retard wheel 22. By loosening nut 53*a*, as wear occurs at a specific portion of the peripheral surface of the stationary wheel 22, the wheel may be rotated to provide a new surface at the nip 23. To provide further rigidity to the mounting of the support or mounting block 24, guide means 55*a,b* are provided.

By turning the adjusting knob 35, the spacing at the nip 23 may be changed. If the spacing is too little, the sheets being fed may tear or wrinkle. If the spacing is too great, more than a single sheet might pass through the nip 23.

The feed wheel 21 is preferably comprised of a soft rubber material whereas the stationary retard surface of wheel 22 is preferably comprised of a hard rubber for less friction and wear.

As a preferred material for the retard wheel, the rubber SBR (80 durometer) a trademark of the Jarco Co. may be employed. For the feed wheel, SBR (60–65 durometer) of the Jarco Co. is used.

With the system disclosed, extremely rapid feed rates may be obtained in a reliable manner. The agitator wheel effectively agitates and loosens only the bottommost sheets for effective feeding to the nip 23 while at the same time providing an automatic "fanning" of the leading edges of the bottommost sheets along the curved surface of the stationary retard wheel. The upper sheets are not fanned and consequently the stack may be easily loaded from the top without disrupting operation since the major portion of the stack abuts against the perpendicular surface shown at 13 in FIG. 1.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A bottom sheet feed system for automatically feeding a stack of sheets, comprising:

a slanted feed surface slanted between 15° and 45° and having means for receiving the stack of sheets;

a first aperture in the feed surface at a location to be beneath the stack of sheets;

a rotatable agitator wheel formed of a plurality of evenly spaced freely rotating agitator rollers beneath the feed surface and partially projecting upwardly through said first aperture, the agitator rollers being evenly spaced from a central axis of the wheel and along a circle, the rollers being spaced from one another and being positioned beneath the feed surface such that when the rollers strike a bottom-most sheet, it is partially lifted from its rest position on the feed surface;

all of the rollers being of the same dimensions and of the same material having a coefficient of friction sufficiently low to prevent wrinkling or bending the bottom-most sheet;

a peripheral surface of the freely rotating rollers of the agitator wheel being slightly convex and formed of a fiberous material;

first drive means for rotating the agitator wheel in a direction of feed;

at an edge of the feed surface a feed nip means being positioned for permitting feed of a single bottom sheet from a leading edge of the stack of sheets;

said feed nip means comprising a rotatable feed wheel substantially beneath the feed surface and a stationary retard surface adjacent the feed wheel;

a spacing of the feed nip means being adjustable by providing an adjustment means for moving the retard surface relative to the feed wheel;

second drive means connected for driving the feed wheel in the feed direction;

the edge at which the feed nip means is located comprising a second aperture in the feed surface;

the stationary retard surface of the feed nip means comprising a stationary retard wheel mounted below and in a pocket portion of a support member having a perpendicular abutment surface against which uppermost sheets of the stack of sheets abut, and wherein lower-most sheets of the stack are fanned along the retard wheel, said retard wheel being dimensioned to contact no more than a ⅜" thick stack of the bottom-most sheets; and the sheet feed system being capable of handling at least 10,000 sheets per hour.

2. A system according to claim 1 wherein the agitator wheel comprises flat circular discs spaced from one another with axles running therebetween upon which the freely rotating rollers are mounted.

3. A system according to claim 1 wherein two of said agitator wheels are provided projecting through two respective apertures in the feed surface, the two agitator wheels being connected to a common shaft.

4. A system according to claim 1 wherein the nip means is provided at a rectangular aperture in the feed surface downstream of a feed direction of the aperture for the agitator wheel.

5. A system according to claim 1 wherein the system feeds up to 20,000 sheets per hour.

6. A system according to claim 1 wherein the stationary retard surface is comprised of a hard rubber and the feed wheel is comprised of a relatively softer rubber.

7. A system according to claim 1 wherein the agitator wheel is positioned such that the bottommost sheet of the stack of sheets is in constant contact with at least one of the freely rotating rollers of the agitator wheel.

* * * * *